US005699915A

United States Patent [19]

Berger et al.

[11] Patent Number: 5,699,915

[45] Date of Patent: Dec. 23, 1997

[54] PALLETIZED PEAT MOSS IN BULK COMPRESSED FORM

[75] Inventors: Régis Berger; Yves Gauthier; Albert Couillard; Rolland Belzile, all of Quebec, Canada

[73] Assignee: Berger Mix Inc., Quebec, Canada

[21] Appl. No.: 746,455

[22] Filed: Nov. 12, 1996

Related U.S. Application Data

[60] Continuation of Ser. No. 472,242, Jun. 7, 1995, abandoned, which is a division of Ser. No. 170,893, Dec. 21, 1993, Pat. No. 5,477,658.

[51] Int. Cl.[6] ..... B65D 19/00

[52] U.S. Cl. ..... 206/597; 206/524.1; 53/399

[58] Field of Search ..... 206/83.5, 442, 206/597, 524.1; 53/399

[56] References Cited

U.S. PATENT DOCUMENTS

| | | | |
|---|---|---|---|
| 181,389 | 8/1876 | Ancher | 206/83.5 |
| 496,042 | 4/1893 | Dederick | 206/83.5 |
| 3,429,095 | 2/1969 | Huson | 206/83.5 |
| 3,883,989 | 5/1975 | Melvold . | |
| 4,500,001 | 2/1985 | Daniels | 206/597 |
| 4,507,122 | 3/1985 | Levesque . | |
| 4,610,596 | 9/1986 | Bouldin et al. . | |
| 4,879,861 | 11/1989 | McAdams | 206/83.5 |
| 5,111,931 | 5/1992 | Gombos et al. | 206/442 |
| 5,353,936 | 10/1994 | Dockstader et al. | 206/597 |
| 5,390,783 | 2/1995 | Gombos et al. | 206/442 |
| 5,477,658 | 12/1995 | Berger et al. | 53/399 |

FOREIGN PATENT DOCUMENTS 1043310 11/1978 Canada .

*Primary Examiner*—David T. Fidei
*Attorney, Agent, or Firm*—Swabey Ogilvy Renault

[57] ABSTRACT

Peat moss is palletized in bulk compressed form by holding a predetermined quantity of peat moss stacked vertically on a pallet to confine the peat moss to a desired, compressed shape, the peat moss having a water-content ranging from about 25 to about 50 weight % and a density ranging from about 0.05 to about 0.15 gm/cc on dry basis, and downwardly compressing the peat moss directly onto the pallet at a pressure ranging from about 3 to about 5 kg/cm$^2$ so as to form the peat moss into a coherent, shape-retaining body without substantially altering the water-content and intrinsic properties of the peat moss. The body of compressed peat moss maintains a structural integrity for a period of time sufficient to permit wrapping thereof. Such a body of compressed peat moss is then wrapped to retain the peat moss in compressed form on the pallet. The invention enables one to significantly increase the quantity of peat moss per unit of shipment.

2 Claims, 9 Drawing Sheets

FIG. 10
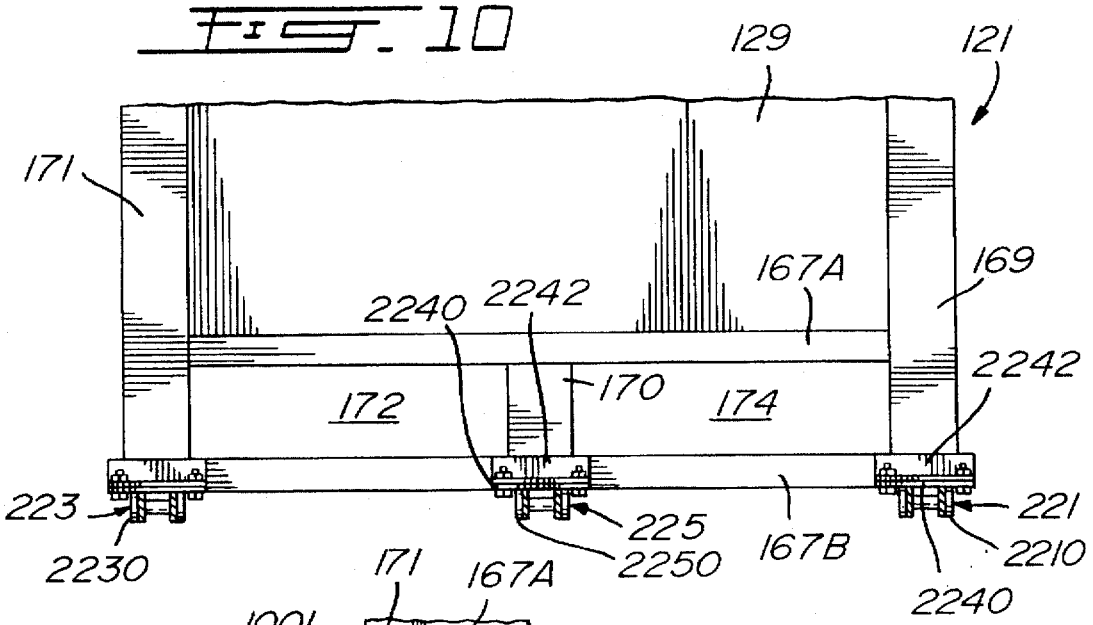
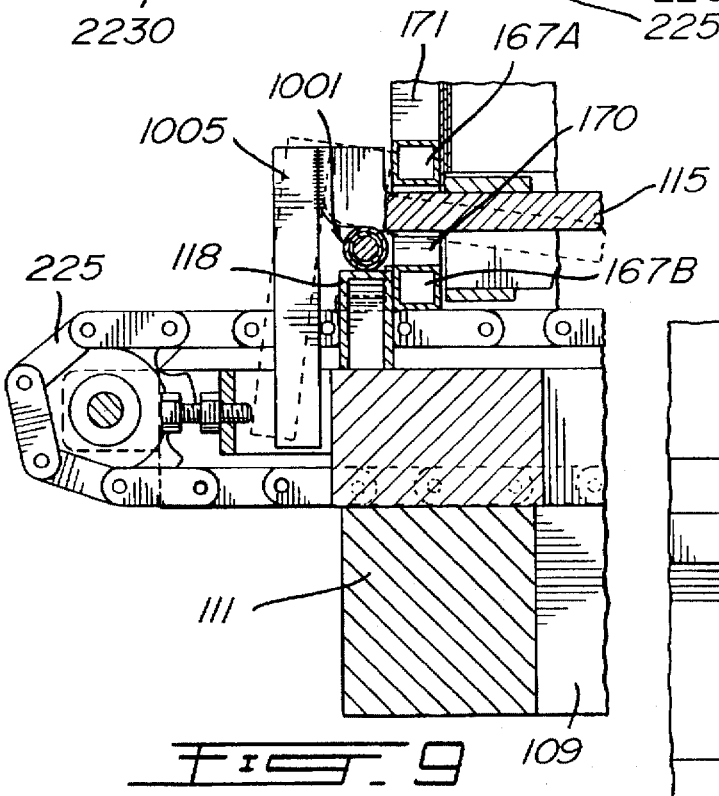
FIG. 9
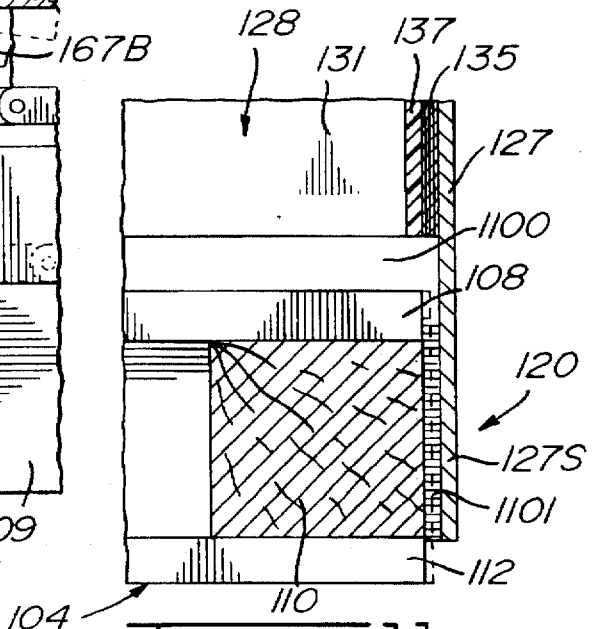
FIG. 11

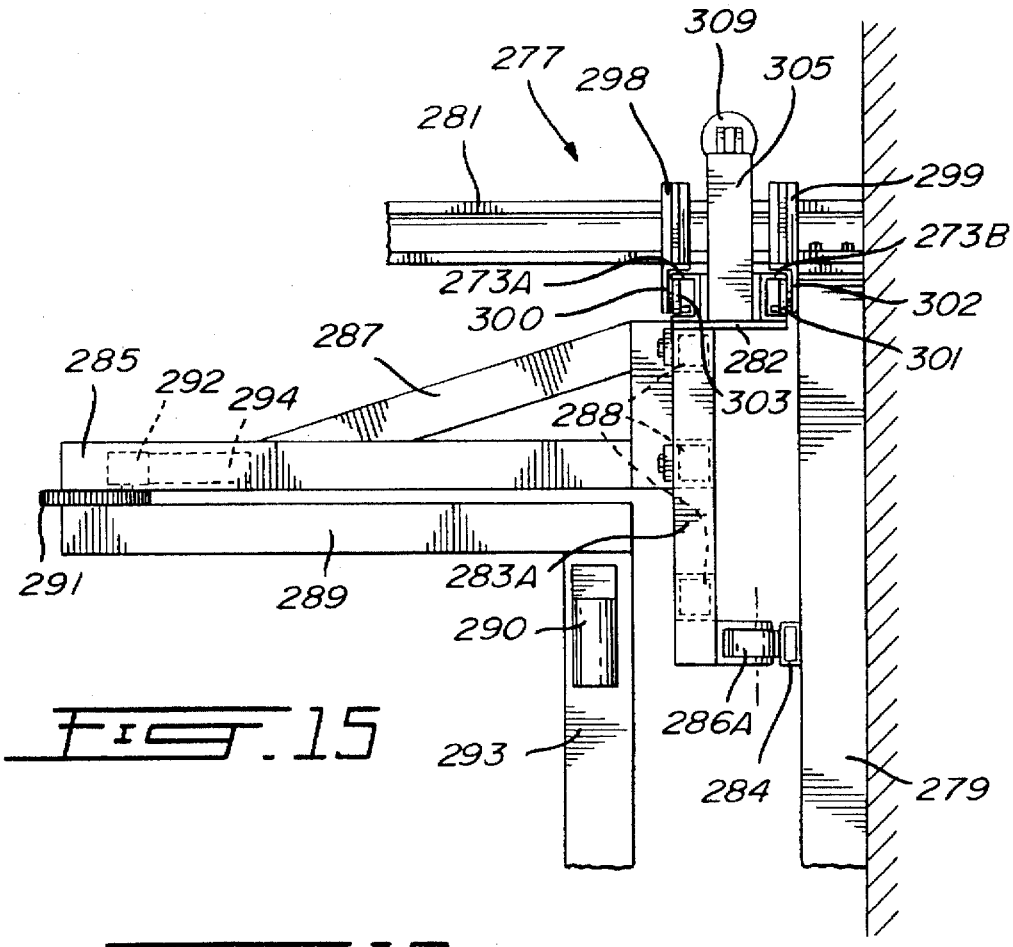
FIG. 15
FIG. 16
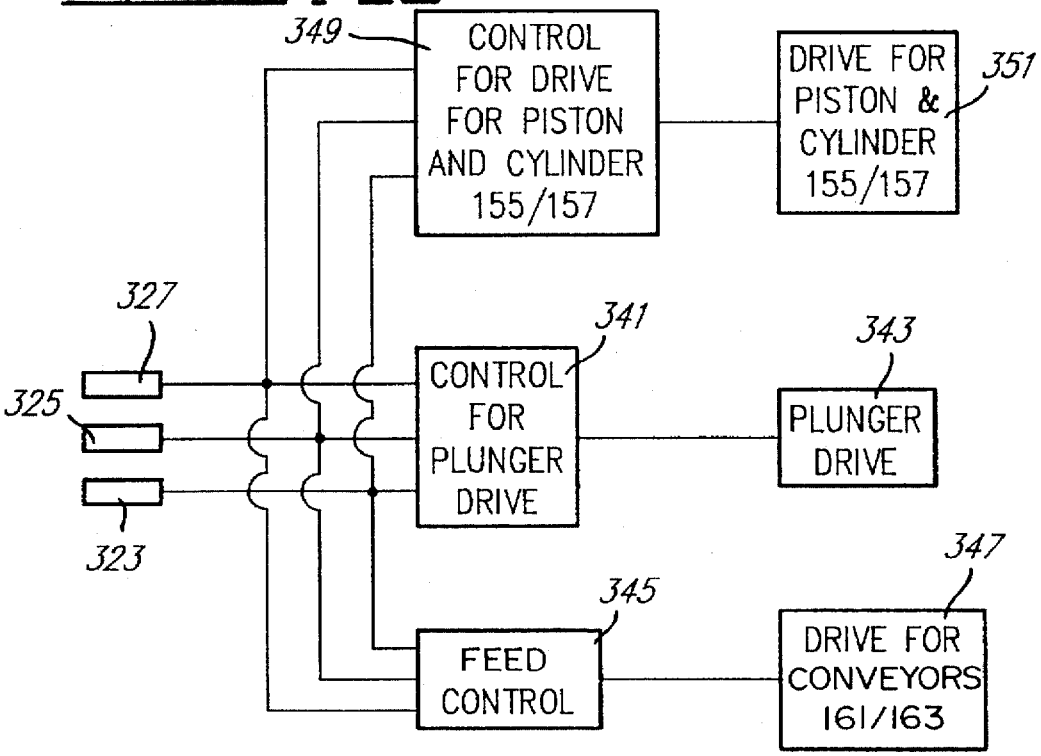

PALLETIZED PEAT MOSS IN BULK COMPRESSED FORM

This application is a continuation of application Ser. No. 08/472,242, filed Jun. 7, 1995, now abandoned, which is a divison of application Ser. No. 08/170,893, filed Dec. 21, 1993, now U.S. Pat. No. 5,477,658.

BACKGROUND OF THE INVENTION

1. Field of the Invention

The present invention relates to improvements in the field of bulk shipping. More particularly, the invention pertains to a method and apparatus for palletizing peat moss in bulk compressed form as well as to the palletized peat moss obtained thereby.

2. Description of Prior Art

Owing to its unique porous structure, peat moss can absorb from about 8 to about 20 times its weight in water. Such a high absorption capacity renders peat moss particularly suitable for use in absorbent products such as diapers, sanitary napkins, tampons and the like. For example, in U.S. Pat. No. 4,507,122, a low density peat moss board is formed from a slurry of screened peat moss in admixture with mechanical wood pulp. The board is used as a central core in body fluid absorbing products.

Peat moss is also widely used in horticulture as soil adduct, compost, culture base, etc. As described in U.S. Pat. No. 3,883,989, expandable shape-retaining peat moss briquettes suitable for growing plants can be produced by intermixing an aqueous bituminous emulsion with peat moss in critical proportions of peat moss to bitumen, drying the mixture and compressing individual portions of the dried mix uni-directionally to form rigid bodies. These bodies are expanded by contact with water to form soft, moist, shape-retaining cakes for, growing plants therein. French Pat. No. 2,099,177, on the other hand, describes a synthetic soil substrate made from compressed peat moss/vermiculite mixtures. A mixture of exfoliated vermiculite and peat moss in critical ratios of vermiculite to peat moss is compressed to ⅓ to 1/20 of its original volume to form pellets. These pellets may be used in containers where they are expanded by the addition of water to form a very active plant soil especially suitable for potted plants and seedlings.

In view of its multiple usage, peat moss is shipped throughout the world from major peat-bogs located predominantly in USSR and Canada. Peat moss is generally packaged under compression into plastic bags for shipment. A typical apparatus for packaging peat moss into bags is described in Canadian Patent No. 1,043,310. The volume of a bag filled with compressed peat moss is usually not larger than about 0.17 cubic meter in order to facilitate handling and shipping. Thus, a single shipment of peat moss may comprise thousands of such bags. The quantity of plastic bags utilized for packaging, and discarded after use, is of course phenomenal and represents a serious threat to the environment. On the other hand, bulk shipping of peat moss in large containers must be effected rapidly since a prolonged exposure of peat moss to atmospheric oxygen causes a bacterial decomposition of the peat moss.

SUMMARY OF INVENTION

It is therefore an object of the present invention to overcome the above drawbacks and to significantly increase the quantity of peat moss per unit of shipment, while preventing bacterial decomposition of the peat moss during storage and/or shipment and minimizing the quantity of plastic material discarded.

According to one aspect of the present invention, there is provided a method of palletizing peat moss in bulk compressed form. The method of the invention comprises the steps of:

a) holding a predetermined quantity of peat moss stacked vertically on a pallet to confine the peat moss to a desired, compressed shape, in the absence of a bag supported to receive the peat moss the peat moss having a water-content ranging from about 25 to about 50 weight % and a density ranging from about 0.05 to about 0.15 gm/cc on dry basis;

b) downwardly compressing the peat moss directly onto the pallet at a pressure ranging from about 3 to about 5 $kg/cm^2$ so as to form the peat moss into a coherent, shape-retaining body without substantially altering the water-content and intrinsic properties of the peat moss.

c) stopping compression and exposing the body of compressed peat in a free standing position on the pallet, the body of compressed peat moss maintaining a structural integrity for a period of time sufficient to permit wrapping thereof; and d) wrapping the exposed body of compressed peat moss to retain the peat moss in compressed form on the pallet.

Applicant has found quite unexpectedly that peat moss can be palletized in bulk compressed form provided that the peat moss have a water-content in the range of about 25 to about 50 weight % and a density in the range of about 0.05 to about 0.15 gm/cc on dry basis, depending on the degree of decomposition of the peat moss, and that the pressure applied to such a peat moss vary in the range of about 3 to about 5 $kg/cm^2$. If the degree of peat moss decomposition is about H1 to about H3 according to the Von Post scale, the peat moss should have a water-content of about 33 to about 50 weight % and a density of about 0.05 to about 0.07 gm/cc; if the degree of peat moss, decomposition is about H3 to about H5, the peat moss should have a water-content of about 25 to about 40 weight % and a density of about 0.07 to about 0.15 gm/cc. Operating within these ranges of peat moss water-content, density and pressure enables one to form the peat moss into a coherent, shape-retaining body which maintains a structural integrity for a period of time sufficient to permit wrapping thereof. Indeed, Applicant has found that a peat moss containing less than about 25 weight % of water and having a density lower than about 0.05 gm/cc cannot be formed into a coherent, shape-retaining body; in other words, the peat moss after being compressed has no coherence- On the other hand, a water-content higher than about 50 weight % adversely affects the compressibility of the material and, at a density higher than about 0.15 gm/cc, the body of compressed peat moss is very unstable and difficult to handle without crumbling. Moreover, if the pressure applied is lower than about 3 $kg/cm^2$, the compressed peat moss has no coherence; at a pressure higher than about 5 $kg/cm^2$, the water-content and intrinsic properties of the peat moss such as elasticity, porous structure and particle size are altered.

Preferably, the peat moss has a water-content of about 30 to about 40 weight % and a density of about 0.06 to about 0.09 gm/cc on dry basis. Mixtures of peat moss and mineral or organic aggregates can also be used. Examples of mineral aggregates are vermiculite and perlite which act as aerating agents. As organic aggregate, use can be made of wood bark. Such aggregates are generally used in amounts ranging from about 10 to about 40% by volume based on the total volume of the mixture.

According to a preferred embodiment of the invention, step (a) is carried out by positioning the pallet underneath a vertically extending, open-ended tubular housing with a lower end thereof disposed closely adjacent the pallet, the housing defining a compression chamber adapted to receive the peat moss for confining same to the desired, compressed shape, and charging a predetermined amount of peat moss into the compression chamber through a top opening of the housing. Charging of the predetermined amount of peat moss is advantageously effected by charging the peat moss into the compression chamber until the amount of peat moss charged reaches a selected level in the compression chamber whereupon charging is stopped, the selected level corresponds to the predetermined amount. Preferably, the steps of peat moss charging and compressing are repeated to increase the amount of peat moss compressed on the pallet.

The compression step is preferably carried out at a pressure of about 3.85 kg/cm$^2$ and to provide a volume ratio of non-compressed peat moss to compressed peat moss ranging from about 2:1 to about 3:1.

Where use is made of a pallet which includes a top deckboard made of a collapsible material and on which the peat moss is stacked, the top deckboard is supported during compression of the peat moss thereon so as to prevent the deckboard from collapsing.

In another preferred embodiment of the invention, the housing together with the pallet are movable between a first work station whereat the peat moss is charged into the compression chamber and compressed therein, and a second work station whereat the body of compressed peat moss is wrapped, the housing being openable to permit separation between the housing and the body of compressed peat when the housing is at the second work station. After step (b), the housing and the pallet with the body of compressed peat moss thereon and contained within the housing are moved from the first work station to the second work station, the housing is opened, the open housing is retracted to expose the body of compressed peat moss on the pallet and the exposed body of compressed peat moss is wrapped.

The palletized peat moss in compressed bulk form according to the invention has a density ranging from about 0.10 to about 0.45 gm/cc on dry basis. Since the peat moss is compressed and covered with a wrapping material such as a plastic film, exposure of the peat moss to atmospheric oxygen is minimal so that there is substantially no bacterial decomposition of the palletized peat moss. The quantity of plastic wrapping material discarded after use is also minimized.

The present invention also provides, in another aspect thereof, an apparatus for carrying out a method as defined above. The apparatus of the invention comprises tubular shape confining means having a top opening and a bottom opening and defining a compression chamber adapted to receive a predetermined quantity of peat moss for holding the predetermined quantity of peat moss stacked vertically on a pallet disposed under the bottom opening to confine the peat moss to a desired, compressed shape, in the absence of a bag supported to receive the peat moss; feed means for charging the predetermined amount of peat moss into the compression chamber through the top opening when the pallet is disposed under the bottom opening of the shape confining means; and means for downwardly compressing the peat moss in the compression chamber directly onto the pallet so as to form the peat moss into the aforesaid coherent, shape-retaining body. The apparatus further includes means for effecting separation between the shape confining means and the body of compressed peat moss so as to expose the body of compressed peat moss in a free standing position on the pallet, and means for wrapping the exposed body of compressed peat moss to retain the peat moss in compressed form on the pallet.

In a preferred embodiment of the invention, the shaped confining means comprises an openable housing having a first side wall with a front edge and a rear edge, a second side wall with a front edge and a rear edge, and a rear wall with a first edge and a second edge. The rear edge of the first side wall is pivotably connected to the first edge of the rear side wall and the rear edge of the second side wall is pivotably connected to the second edge of the rear wall. The housing further includes a front wall comprising a first portion connected transversely to the first side wall of the front edge thereof and a second portion connected transversely to the second side wall of the front edge thereof, the first and second portions of the front walls having a combined width equal to the width of the rear wall, and means for pivoting the first side wall with respect to the rear wall as well as means for pivoting the second side wall with respect to the rear wall. Such an arrangement enables the first and second portions of the front wall to be separated from each other whereby to open the housing.

According to another preferred embodiment, a housing extension extends above the top end of the housing. The feed means preferably comprises trough means extending from a source of peat moss into the interior of the housing extension and including conveyor means within the trough means for carrying the peat moss from the source of peat moss to the interior of the housing extension.

The apparatus advantageously includes a first conveyor arrangement for conveying the housing between the aforementioned first and second work stations, and a second conveyor arrangement for conveying the palletized peat moss from the second work station to a loading work station. The first conveyor arrangement preferably comprises a plurality of rails extending from the first work station to the second work station, the rails comprising guides for chain means driven thereover. Such a conveyor arrangement further includes a first motor connected to a first driven shaft, the first driven shaft including a plurality of sprocket means equal to the number of rail means, a respective one of the sprocket means being aligned with a respective one of the rail means, whereby when the first motor is turned on, the chain means is driven by the sprocket means over the rails.

The second conveyor arrangement preferably comprises a second plurality of rails extending from the second work station to the loading work station, the plurality of rails comprising guides for second chain means driven thereover. The second conveyor arrangement further includes a second motor connected to a second driven shaft, the second driven shaft including a second plurality of sprocket means equal to the number of second rail means, a respective one of the sprocket means being aligned with a respective one of the second rail means, whereby when the second motor is turned on, the second chain means is driven by the second sprocket means over the second rail means.

BRIEF DESCRIPTION OF DRAWINGS

Further features and advantages of the invention will become more readily apparent from the following description of preferred embodiments as illustrated by way of examples in the accompanying drawings in which:

FIG. 3 is a partly-fragmented side elevational view of an apparatus for palletizing peat moss in accordance with the invention, the housing utilized for confining the peat moss to a desired, compressed shape being shown in broken line at the first work station, and, in solid line, at the second work station;

FIG. 9 is a fragmented sectional view of the base structure illustrated in FIG. 8, showing details of the hinge connection of forked arms utilized for supporting the pallet during compression of the peat moss;

FIG. 10 is a fragmented rear view of the housing;

FIG. 11 is a fragmented sectional view of the housing, showing how pallets of slightly different dimensions may be accommodated within the lower part of the housing;

FIG. 15 is a fragmented right-hand end view of the apparatus illustrated in FIG. 1, showing the mechanism for displacing the wrapping unit between the second work station and a non-working position remote thereof; and FIG. 16 is a block diagram of electrical circuitry for controlling the operation of the apparatus.

DESCRIPTION OF THE PREFERRED EMBODIMENTS

Figure 1:
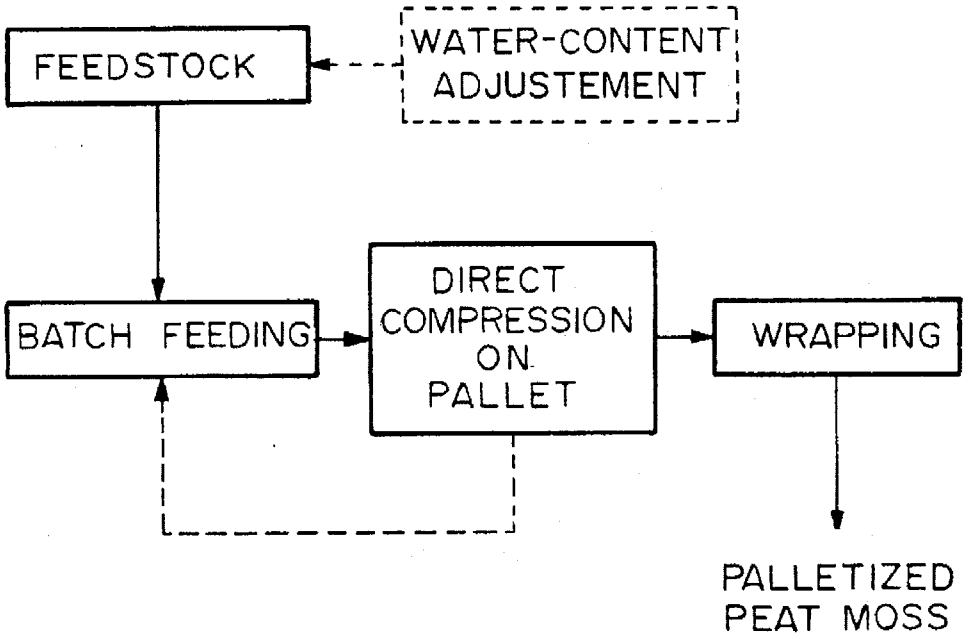
FIG. 1 is an block diagram schematically illustrating a method of palletizing peat moss according to the invention.
Figure 1:
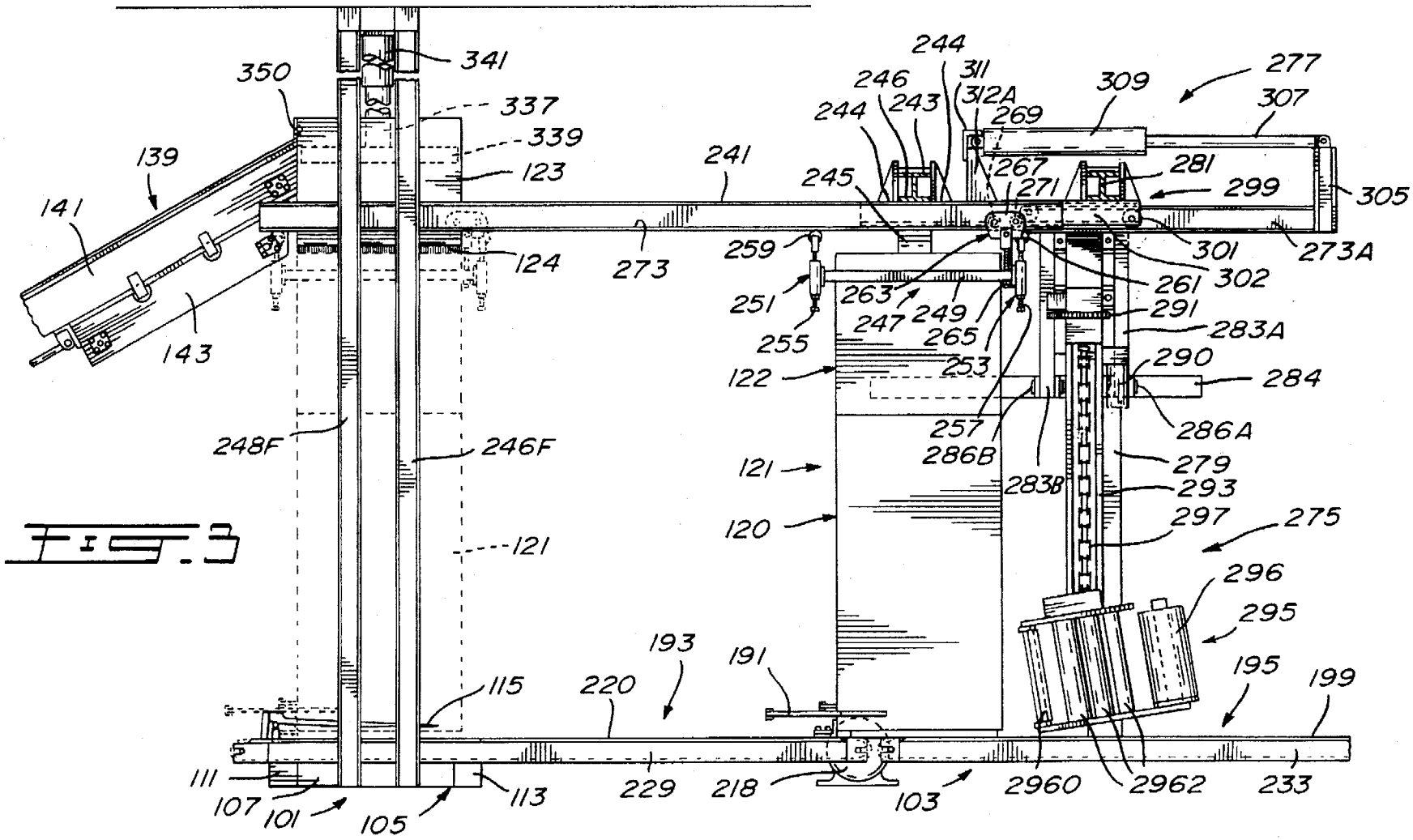

Referring first to FIG. 1, which schematically illustrates the method of the invention, Sphagnum peat moss optionally in admixture with mineral or organic aggregates is used as feedstock. As indicated previously, the peat moss should have a water-content ranging from about 25 to about 50 weight % and a density ranging from about 0.05 to about 0.15 gm/cc on dry basis. If the water-content is too low, i.e., less than 25 weight %, it is adjusted to the desired content by adding water, for example, by means of water sprays. If, on the other hand, the water-content of the peat moss is too high, i.e., higher than 50 weight %, the peat moss is dried by passing same through a rotary kiln.

The peat moss is batch fed to a compression unit for direct compression on a pallet. A predetermined quantity of peat moss is held stacked vertically on the pallet to confine the peat moss to a desired, compressed shape. The peat moss is compressed downwardly onto the pallet at a pressure ranging from about 3 to about 5 kg/cm$^2$ so as to form the peat moss into a coherent, shaped-retaining body without substantially altering the water-content and intrinsic properties of the peat moss. If desired, an additional quantity of peat moss is fed to the compression unit and compressed to increase the amount of peat moss compressed on the pallet. The steps of peat moss feeding and compressing may be repeated several times. In a preferred embodiment, there are three compression strokes. The body of compressed peat moss is then wrapped in a plastic film material to retain the peat moss in compressed form on the pallet.

Figure 2:
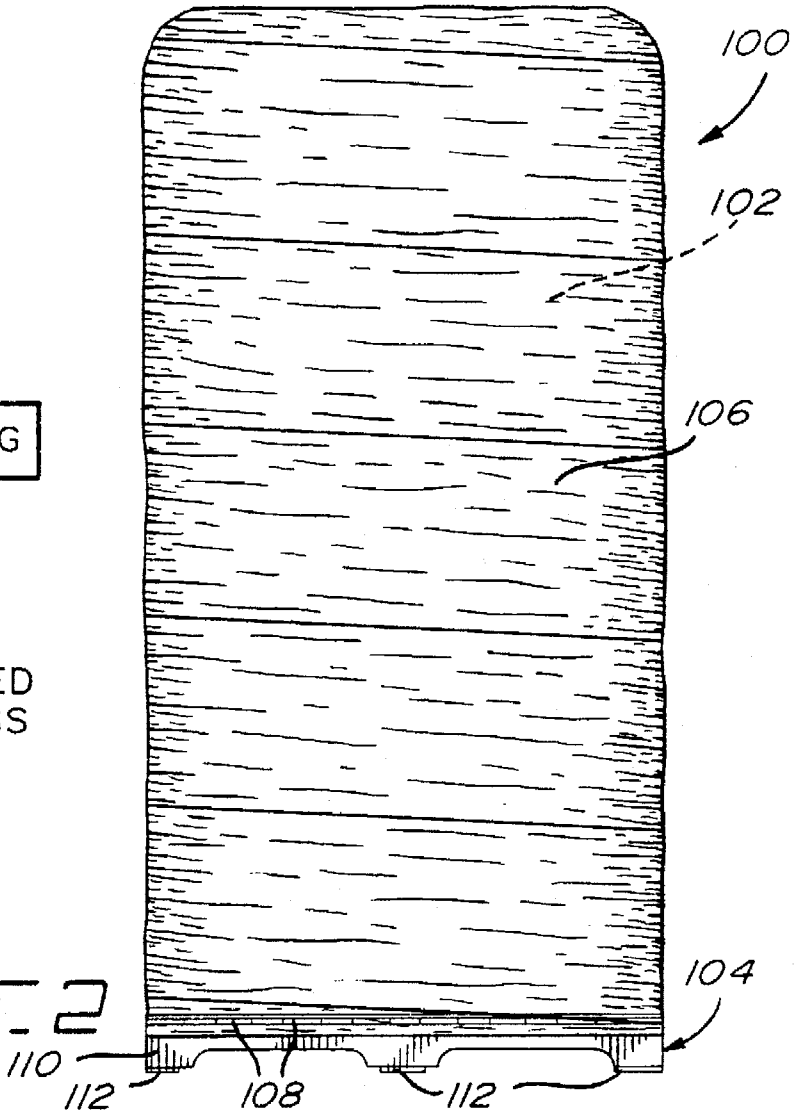
FIG. 2 is a side elevational view showing the palletized peat moss.

As seen in FIG. 2, the palletized peat moss which is obtained by the above method and which is generally designated by reference numeral 100 comprises a body of compressed peat moss 102 upstanding from a pallet 104 and wrapped with a plastic film 106, the plastic film retaining the peat moss in compressed form on the pallet. The pallet 104 is a conventional wooden pallet comprising a top deckboard formed of a plurality of spaced-apart parallel slats 108 fixed to three stingers 110 (only one is shown) which are arranged in spaced-apart parallel relationship to one another and extend transversely of the slats 108. The stringers 110 are each formed with three legs, the respective legs of three stringers being interconnected by transverse slats 112. Typically, the palletized peat moss 100 has a rectangular cross-section with a width of about 1.0 meter and a length of 1.2 meters, the height ranging from about 2.0 to about 2.5 meters. The volume of compressed peat moss retained on the pallet generally ranges from about 2.5 to about 3.2 cubic meters.

Turning to FIG. 3, the inventive apparatus has a first work station 101 and a second work station 103. In the illustrated embodiment, the first work station 101 is a charging and compressing work station, and the second work station 103 is a wrapping work station.

Figure 7:
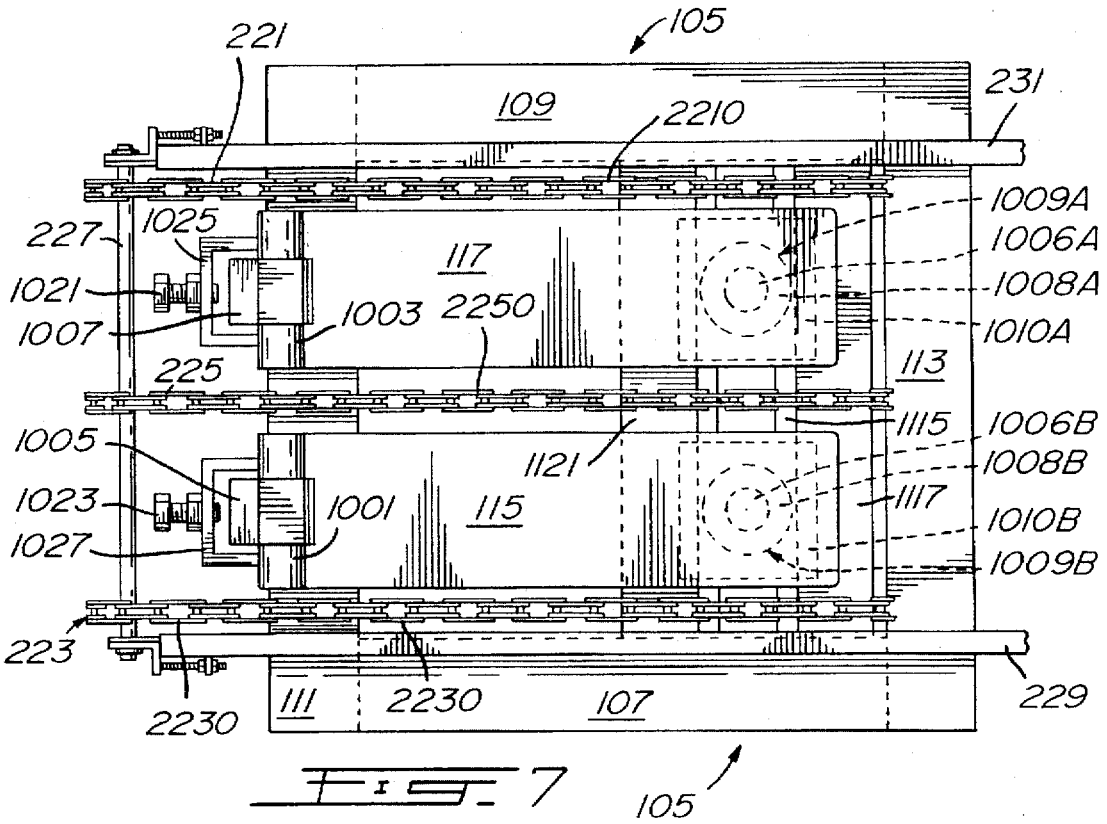
FIG. 7 is a partly-fragmented top view of the base structure at the first work station.
Figure 8:
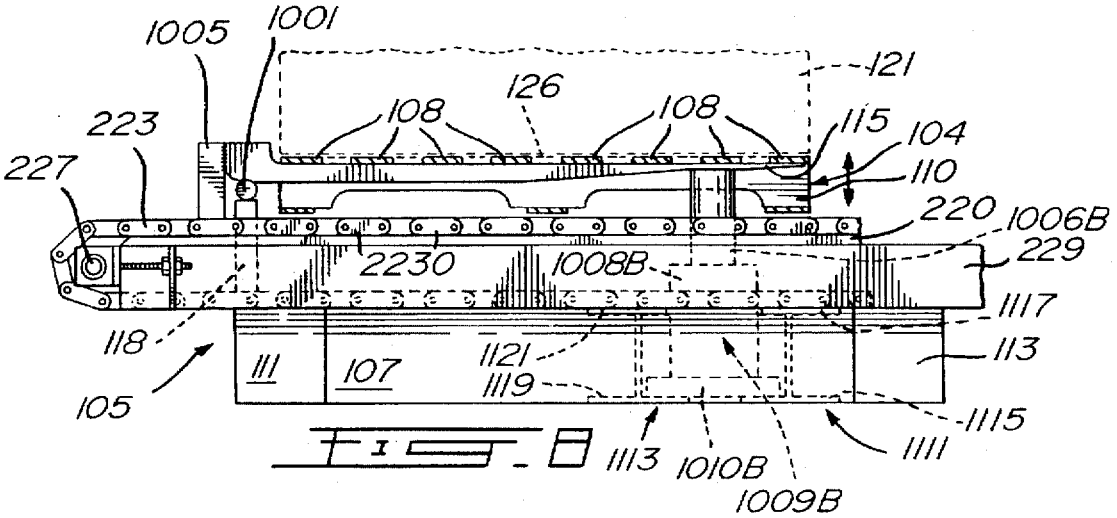
FIG. 8 is a partly-fragmented side view of the base structure illustrated in FIG. 7.

Disposed at the first work station is a base structure 105. As seen in FIGS. 7 and 8, the base structure 105 comprises longitudinal members 107 and 109 which are parallel to each other, and lateral members 111 and 113 which are parallel to each other and transverse to the longitudinal members 107 and 109. Thus, the base structure is in the form of a rectangle.

Referring now to FIGS. 7, 8, and 9, it is seen that fork arm 115 is hingedly connected to the base structure by hinge 1001 which is supported by tubing 118, and fork arm 117 is hingedly connected to the base structure by hinge 113 which is supported by a tubing similar to 118 but not shown in FIG. 9. As seen in FIG. 8, the fork arm 115 supports a portion of the top deckboard of the pallet 104. Similarly, fork arm 117 supports a different portion of the top deckboard of pallet 104. A cardboard or plastic sheet 126 overlies the top deckboard.

Fork arms 115 and 117 are pivotable, respectively, about hinges 1001 and 1003 by movements of adjusting plates 1005 and 1007 whereby to adjust the horizontal attitude of the fork arms 115 and 117. Holding screws 1021 and 1023, which are supported by U-shaped members 1025 and 1027 respectively, are provided to lock the fork arms 115 and 117 into an adjusted position.

As seen in FIGS. 7 and 8, the pallet 104 underlies the housing 121 and is supported by fork arms 115 and 117 which, in turn, are maintained in the support position by hydraulic jacks 1009A and 1009B. The hydraulic jacks are held in position by parallel I-beams 1115 and 1113. I-beam 1111 includes a base span 1115 and a top span 1117. The top span 1117 is cut to permit the extension of the hydraulic jack thereabove. In a like manner, the I-beam 1113 includes a base span 1119 and a top cut span 1121.

As can be seen, the hydraulic jacks 1009A and 1009B each comprise a piston 1006A and 1006B, a cylinder 1008A and 1008B and a base 1010A and 1010B respectively.

Referring to FIG. 3, it can be seen that the apparatus also includes a shaped confining means, which, in the illustrated embodiment comprises a tubular housing 121 having a top opening and a bottom opening. The pallet 104 underlies the bottom opening of the housing 121. Although illustrated herewith as a openable tubular housing, the shape confining means may comprise any means for confining the peat moss to a predetermined shape and for receiving a predetermined quantity of peat moss within its walls. Disposed above the housing 121 is an extension structure 123 whose bottom peripheral edge registers with the top peripheral edge of the top portion 122 of housing 121. Extending downwardly from the bottom peripheral edge of extension structure 123 is R bristles 124 which will prevent peat finds from escaping from the gap between the top peripheral edge of the housing 121 and the registered bottom peripheral edge of the extension 123.

Figure 5:
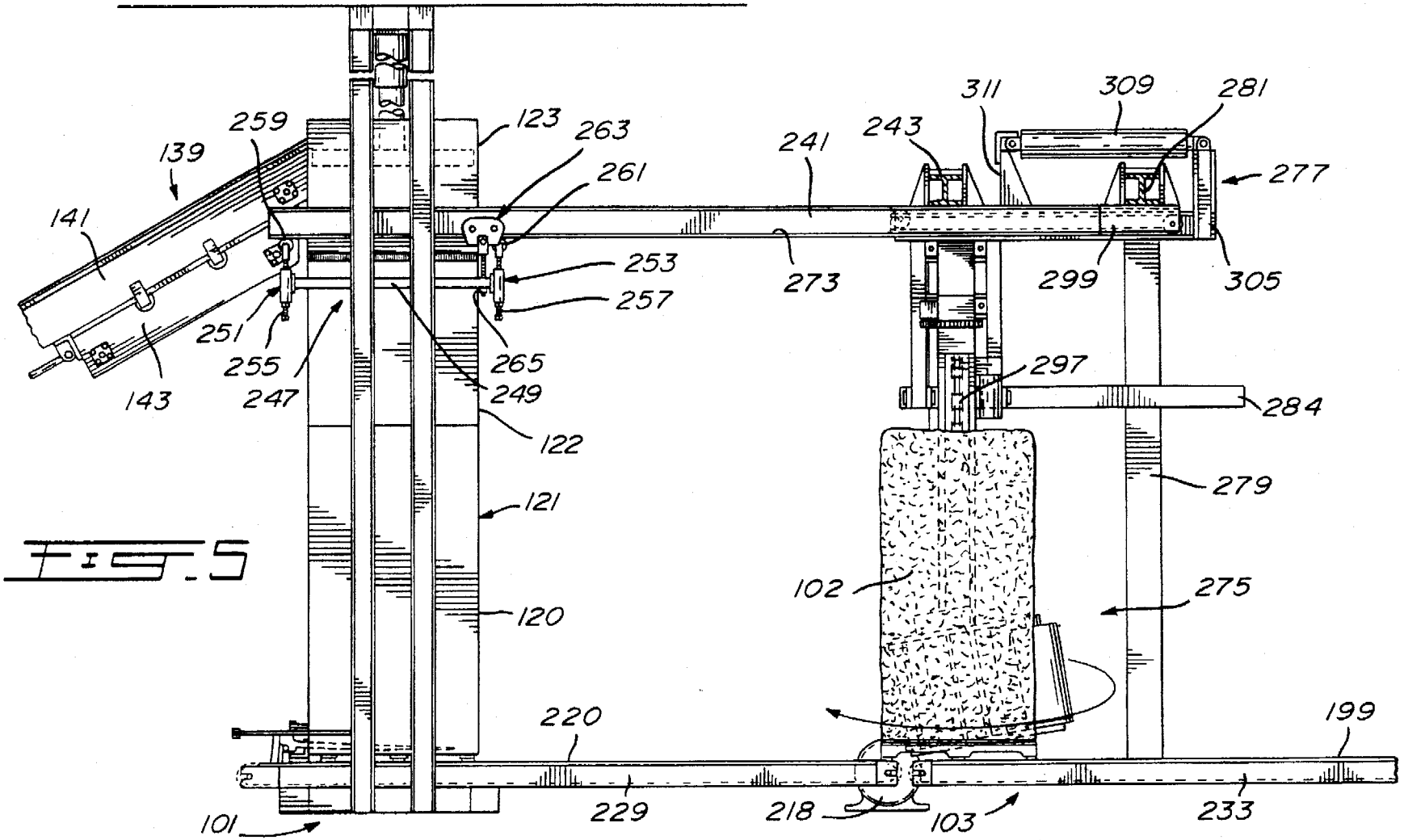
FIG. 5 is another partly-fragmented side elevational view of the apparatus showing the housing at the first work station and a body of compressed peat moss at the second work station.

As can be seen in FIGS. 3 and 5, the housing 121 includes a main or bottom portion 120 and a top portion 122. The interior of the main portion 120 defines a compression chamber 128 (shown in FIGS. 11 and 12).

Figures 4, 4A:
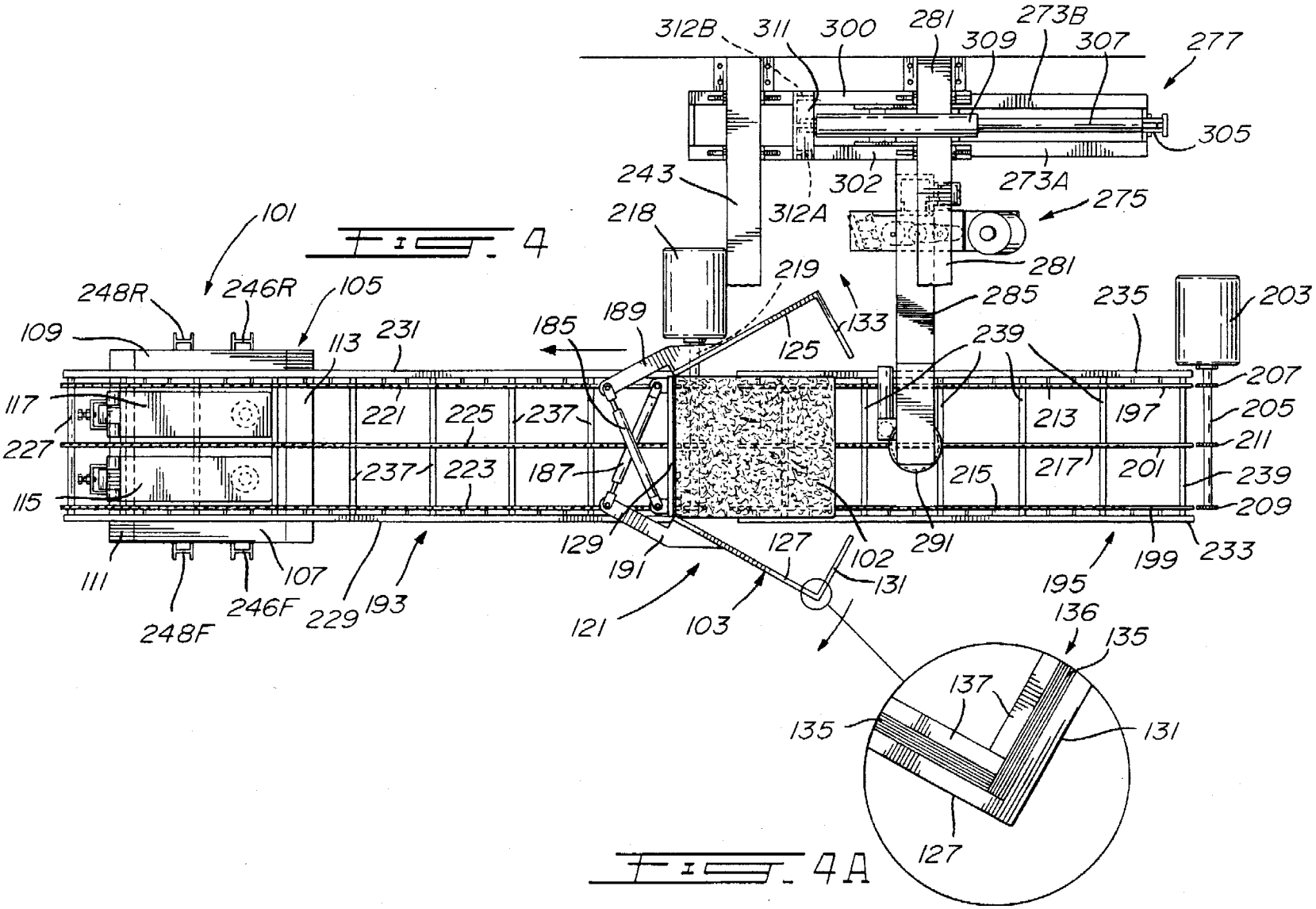
FIG. 4 is a top view of the apparatus illustrated in FIG. 1, showing the housing in its open position at the second work station.
FIG. 4A is an enlarged, fragmented top view of the portion encircled in FIG. 4.

As can be seen in FIG. 4, the bottom portion 121 of the housing has side walls 125, 127, a rear wall 129 and a front wall which consists of a first half 131 and a second half 133. Top portion 122 also has four walls with, and the bottom peripheral edges of the four walls of the top portion 122 are in registration with the peripheral top edges of the walls of the bottom portion 120.

All of the walls of the housing 121 includes spacer means 136 as best shown in FIG. 4A. The spacer means may comprise a plywood board 135, or a like material and a non-adhesive surface layer 137 which may be made of, for example, Teflon™.

Figure 6:
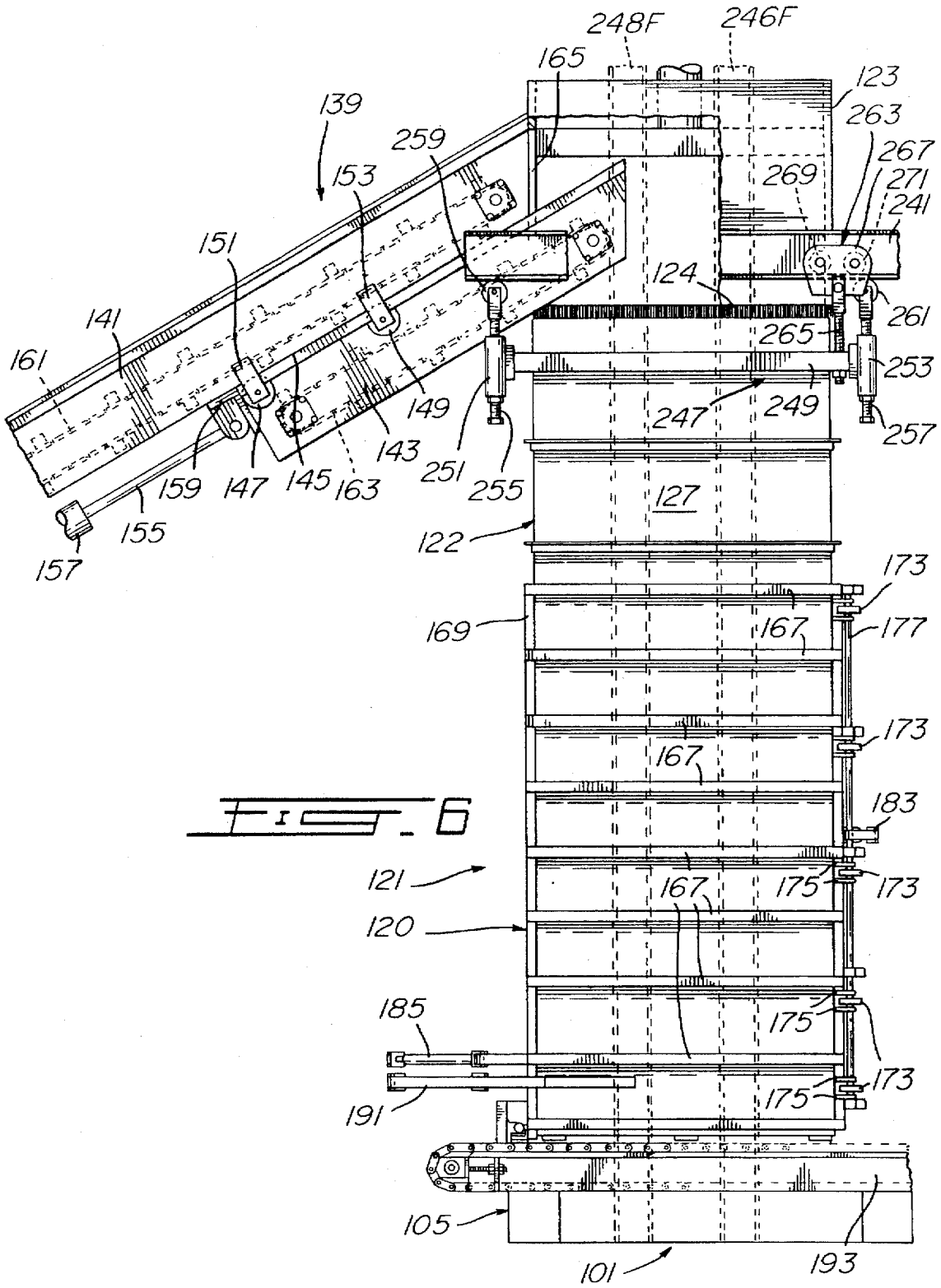
FIG. 6 is a fragmented side elevational view showing details of the housing and feed means.

Turning now to FIGS. 3 and 6, it is seen that a feed means 139 for charging the housing 121 is included adjacent to the extension 123. As seen in FIG. 6, the feed means 139 for charging comprises a first trough 141 and a second trough 143 which are relatively movable. In the illustrated embodiment, trough 143 is movable relative to trough 141.

The troughs are of generally rectangular cross section having two side walls and a bottom wall, and trough 141 has a top wall as well. Trough 143 has L-shaped flanges 145 extending along the top edge of both side walls. Trough 141 supports wheels 147 and 149 by plates 151 and 153 respectively on one side wall. The wheels extend into the space underlying the L-shaped flange 145.

As will be apparent, a similar pair of wheels is supported on the other side wall of the top trough 141 to extend into the L-shaped flange on the other side wall of the second trough 143.

The free end of piston 155 of piston and cylinder arrangement 155/157 is connected to a bracket 159 which is connected to the bottom trough 143. With the piston and cylinder arrangement, the bottom trough 143 can be moved from a charging position, as shown in FIG. 6, to a retracted position as shown in FIG. 3.

Belt conveyors 161 and 163 are disposed in the top and bottom troughs 141 and 143 respectively. The belt conveyors 161, 163 are driven by separate motors (not shown).

In the feed position, trough 143 extends through the opening 165 in the rear wall of extension 123, and the discharge end of the trough 143 is disposed such as to discharge peat moss into the compression chamber 128. Substantially centrally thereof, to thereby form a substantially uniform stack of peat moss in the compression chamber.

As also seen in FIG. 6, the housing 121 is surrounded by horizontal reinforcing members 167. The members 167 extend all the way around the housing, that is, on both side walls, the rear wall and the front wall. On the front wall, the members 167 comprise two half portions fitting on each half of the front wall. The reinforcing members may comprise metal tubular members.

As seen in both FIGS. 6 and 10, vertical reinforcing members 169 and 171 extend along the rear wall 129 at either edge thereof. Once again, the members 169 and 171 may comprise metal tubular members.

A central member 170 extends between brace members 167A and 167B. One half of 167A, 170 and 171 and one half of 167B define a hollow space 172 for receiving fork arm 117, and the other half of 167A, 170, 169 and the other half of 167B define a hollow space 174 for receiving fork arm 115.

Figure 12:
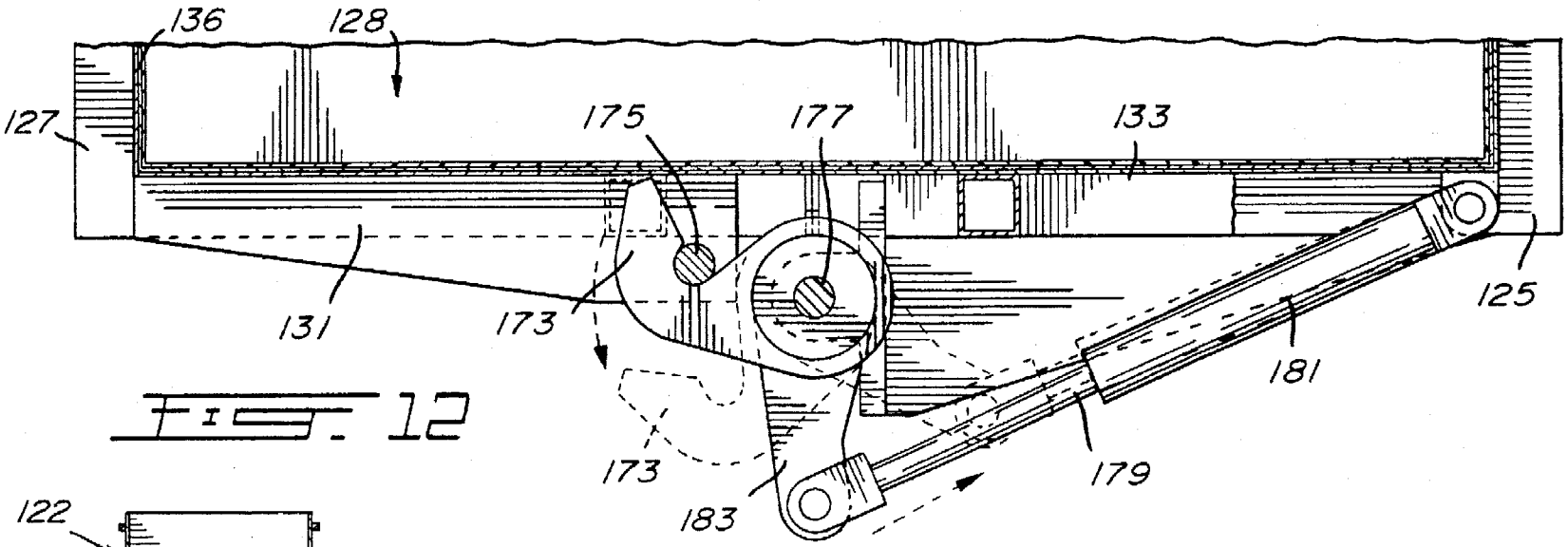
FIG. 12 is another fragmented sectional view of the housing, showing details of the locking mechanism of the housing.

The housing 121 is lockable by a lock arrangement extending between the two halves 131, 133 of the front wall of the housing 121 and lockably connects the free edges of the two halves of the front wall to each other. Referring to FIGS. 6 and 12, the locking arrangement includes a plurality of catches 173, placed in spaced arrangement along the length of the front wall. Each catch is in the shape of a hook member as seen in FIG. 12.

Each catch engages a respective strike 175. The strikes 175 are also placed in spaced arrangement along the length of the front wall such that each strike is engageable by a respective catch. As seen in FIGS. 6 and 12, the strike 175 is a short cylinder.

Extending along the front wall of the housing 121 is a catch rod 177. The free end of piston 179 of piston and cylinder arrangement 179/181 engages one end of lever arm 183. The other end of the lever arm 183 engages the catch rod 177 whereby to rotate catch rod 177 by the movement of the piston 179. By retracting the piston 179, the catch rod 177 will be forced to rotate in a counterclockwise direction whereby to move each catch 173 into the position shown in dotted lines in FIG. 12. Extending piston 179 will force catch rod 177 to rotate in a clock-wise direction.

When the piston 179 is extended, as shown in FIG. 12, the catches 173 will engage their respective strikes 175 as shown in solid lines in FIG. 12. With the catches engaging the strikes as shown in solid lines in FIG. 12, the housing 121 will be shut and locked. The piston and cylinder arrangement 179/181 is controlled by means well known in the art.

To separate the two halves 131 and 133 of the front wall of the housing 121, whereby to open the housing, as shown in FIG. 4, piston 179 would be retracted, to unlock housing 121, and piston and cylinder arrangements 185 and 187 would be activated to retract their pistons. The free ends of the pistons of the arrangements 185 and 187 are connected, respectively, to one end of lever arms 189 and 191 respectively. The other ends of lever arms 189 and 191 are connected, respectively, to side walls 125 and 127 of housing 121. The side walls 125 and 127 are pivotable, by virtue of their being hingedly connected to rear wall 129. Accordingly, by retracting the pistons of the piston and cylinder arrangements 185 and 187, the front wall halves 131 and 133 together with the side walls 125 and 127 separate as shown in FIG. 4.

Returning now to FIG. 4, it can be seen that there is a first conveyor arrangement 193 for conveying the housing from the first work station 101 to the second work station 103, and a second conveyor arrangement 195 for conveying a body of compressed peat moss from the second work station to a shipping station (not shown). As seen in the second conveyor arrangement 195, the arrangement comprises a first rail 197, a parallel second rail 199 and a parallel central rail 201. Although the rails are shown only for the second conveyor arrangement, similar rails are provided for the first conveyor arrangement 193, such as rail 220 shown in FIGS. 3, 5 and 8.

Disposed at the end of the second conveyor arrangement is a drive motor 203 which is connected to a drive shaft 205. Mounted on the drive shaft are sprockets 207, 209 and 211. Sprocket 207 is disposed adjacent to the rail 197, sprocket 209 is disposed adjacent to the rail 199, and sprocket 211 is disposed adjacent to the rail 201.

Endless chains 213, 215 and 217 are mounted on the rails 197, 199 and 201 respectively and pass over the sprockets 207, 209 and 211 respectively. Disposed at the other end of the second conveyor arrangement is a driven shaft (not shown) which also includes sprockets. Chains 213, 215 and 217 pass over these sprockets as well. Accordingly, when motor 203 operates, the chains 213, 215 and 217 are driven clockwise to carry with it a palletized body of peat moss as will be described below.

In the first conveyor arrangement, a drive motor 218 drives a drive shaft 219, which also includes sprockets, similar to the sprockets 207, 209 and 211 on the drive shaft 205.

Rails, similar to the rails respectively with 197, 199 and 201 in the second conveyor arrangement, mount chains 221, 223 and 225. Sprockets (not seen) are mounted on driven shaft 227 at the left-hand end of the first conveyor arrangement.

As seen in FIGS. 7 and 8, chain 223 comprises a plurality of chain links 2230 and chain 221 comprises a plurality of chain links 2210. In a like manner, chain 225 comprises a plurality of chain links 2250.

As seen in FIG. 10, a cross plate 2240 extends across, and is welded to, one of the chain links 2230. The cross plate 2240 is connected to an L-shaped bracket 2242 which is welded to member 167B of the housing 121. Similar arrangements connect chains 225 and 221 to the housing 121. Accordingly, the lower rear end of housing 121 is connected to the chains 221, 223 and 225 for movement therewith.

Accordingly, when motor 218 is activated, the chains 221, 223 and 225 will be driven clockwise whereby to convey the housing 121, charged with compressed peat moss, from the first work station 101 to the second work station 103, as will be described below.

As seen in FIGS. 3 and 4, the apparatus includes side runners 229 and 231 which extend along either side of the first conveyor arrangement 193 and along the full length thereof, and side runners 233 and 235 which extend along the other side of the second conveyor arrangement 195 and along the full length thereof. Braces 237, which are preferably cylindrical metal members, connect the side runner 229 to 231 to each other and maintain the spacing between them and braces 239, which may also be cylindrical metal members, connect the side runners 233 and 235 to each other and maintain the spacing between these side runners.

The apparatus also includes two parallel suspension beams extending horizontally on either side of the housing. Only one such beam, 241, is shown in FIGS. 3 and 5.

The suspension beams, including beams 241, are supported at one end by a cross beam 243 which extends transversely to the suspension beams. As can be seen, cross beam 243 is connected to suspension beam 241 by flanges 244 and by span 246. Beam 243 is also connected to the parallel suspension beam in the same way.

Cross beam 243 is supported by vertical column 245 which extends along a side wall in the building in which the apparatus is housed, or which could be free-standing on the floor of the building by being first secured to the floor.

As can be seen, the other ends of the two parallel suspension beams, including beam 241, are supported by vertical beams 246F,248F, on one side of the housing, and vertical beams 246R,248R on the other side thereof as shown in FIGS. 3 and 4.

Suspension beam 241 supports a hold-down mechanism 247, the purpose of which will be described below. As can be seen in FIG. 3, the hold-down mechanism 247 comprises a horizontal bar 249 which is attached to a side wall of the housing 121. A similar horizontal bar (not shown) is attached to the other side wall of housing 121 in parallel arrangement with the bar 249.

Vertical spacers 251, 253 extend between either end of the horizontal bar 249 and the suspension beam 241. Similar spacers extend between the horizontal bar, on the other side wall of the housing 121, and the other suspension beam which is also on the other side of the housing 121.

The hold down means 251 and 253 comprise screw adjustment arrangements 255 and 257 respectively and wheels 259, 261 respectively. Similar screw adjustment arrangements are included on the hold down means on the other side wall of the housing 121.

Also extending between the suspension beam 241 and the horizontal bar 249 is a level suspension and adjust arrangement 263. As better seen in FIG. 6, the suspension and level adjust arrangement 263 includes a screw adjust arrangement 265.

The suspension and level adjust arrangement 263 is provided to level the housing 121 so that its top and bottom surfaces are horizontal. It is also provided to suspend the front end of the housing 121 as the bottom end of the housing 121 is fixed to the rails only at the back end thereof.

Once again, a similar suspension and level adjust arrangement extends between the other suspension beam and the horizontal bar on the other side of the housing 121.

The suspension and level adjust arrangement 263 comprises a carrier 267 and two wheels 269 and 271 as seen in FIG. 6. The wheels run along flange 273 of suspension beam 241. Similar wheels in the suspension and level adjust arrangement on the other side of the housing 121 will run along a similar flange of the other suspension beam on the other side of the housing 121.

The apparatus also includes a wrapping unit, illustrated generally at 275 in FIG. 3. The wrapping unit 275 includes a wrapping unit conveyor arrangement, illustrated generally at 277 in FIGS. 3 and 15, which is supported by horizontal beam 281 which is, in turn, supported by vertical column 279.

Parallel carrier arms 283A and 283B, which are spaced from the vertical column 279, support a cantilever arm 285 which has a truss 287 to provide structural support for the cantilever arm 285. Wheels 286A and 286B roll along tubular member 284 which, as best seen in FIG. 15, includes two flat surfaces one of which engages a flat surface of the vertical column 279. The other flat surface is the surface along which wheels 286A and 286B roll.

The top ends of arms 283A and 283B are connected to one surface of plate 282 (only the connection to 283 is shown in FIG. 15). The other surface of plate 282 is connected to moveable rails 273A and 273B. Braces 288 extend between arms 283A and 283B. Wheels 301 and 303 are mounted by rails 273A and 273B respectively. Fixed rails 300 and 302 are interlinked with, respectively, moveable rails 273A and 273B.

Post 305 interconnects the free ends of moveable rails 273A and 273B and supports the free end of piston 307 of piston and cylinder arrangement 307/309. The end of cylinder 309 is connected to bracket 311 which is fixed to connector members 312A, 312B. Connector members 312A and 312B are connected to fixed rails 302 and 300 respectively.

Thus, when piston and cylinder arrangement 307/309 is actuated, and the piston 307 is retracted into the cylinder 309, it will pull with it the post 305. This will cause rails 273A, 273B to move, with the help of wheels 301 and 303, relative to fixed rails 302 and 300 respectively. As the moveable rails 273A, 273B are moved, plate 282 is also moved carrying with it carrier arms 283A and 283B. Accordingly, the wrapping unit 275 will be moved from the inoperative position, as shown in FIG. 3, to the working, or operative position, as shown in FIG. 5.

The wrapping unit 275, which, in a particular embodiment, can comprise an Orion M-66 Rotary Tower, includes a rotating arm 289. The rotating arm which has a common shafter with circular gear 291 is rotated by the rotation of the circular gear 291 which engages with driven gear 292. Driven gear 292 is driven by a motor 294 as is well known in the art and therefore requires no further description.

Returning to FIG. 3, the wrapping unit also includes a vertical post 293 which supports a roller arrangement 295. The roller arrangement 295 includes a feed roll 296, which carries the plastic film, an applicator roll 2960, which applies the plastic film, and stretch rolls 2962, which pre-stretch the plastic film before it is applied. A conveyor chain 297, driven by motor 290, conveys the roller arrangement 295 up-and-down the vertical post 293.

As above mentioned, and as shown in FIG. 4, the interior surfaces of the walls of housing 121 include spacer means 136. The reason for the spacer means 136 is best understood by examination of FIG. 11. As can be seen, the cross-sectional area of the housing 121, defined by the inner surfaces of the non-adhesive layer 137, is smaller than the cross-sectional area of surface of the top deck of the pallet 104. Thus, the peat moss body, which is formed in housing 121, as will be described below, and as is shown in FIG. 1, has a cross-sectional area smaller than the area of the surface of the top deck of the pallet 104.

As is well known, compressed peat moss has a tendency to expand. If the surface area of the top deck of the pallet 104 were not larger than the cross-sectional area of the body of compressed peat moss, then this body would over run the edges of the pallet when it expanded. It is therefore necessary to have a pallet whose cross-sectional area of the surface of the top deck is larger than the cross-sectional area of the body of the compressed peat moss.

To accommodate such a pallet, the bottom of the housing 121 must have a larger cross-sectional area than the remainder of the housing. For this purpose, the bottom ends of the walls of the housing 121 have inner surfaces which do not have spacer means 136. One such wall bottom is shown at 127S in FIG. 11. Space 1100 insures that pallets of different heights can be accommodated, and space 1101 permits the accommodation of pallets of different cross-sectional area.

Figure 13:
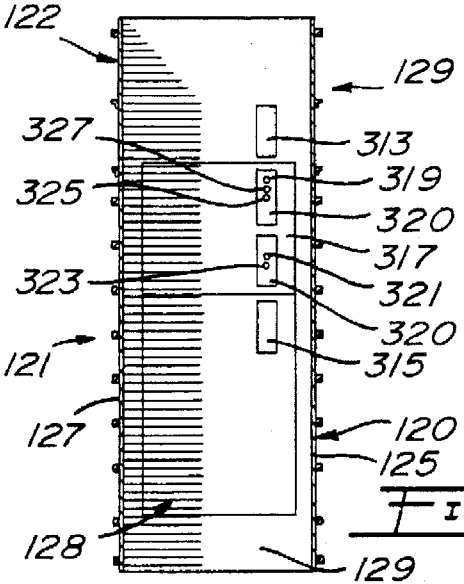
FIG. 13 is a sectional view of the housing, showing the inner rear wall thereof.

Turning to FIG. 13, it can be seen that the rear wall 129 of the housing 121 includes an upper window 313 and a lower window 315. Rear wall 129 also includes door 317 which permits access into the compression chamber 128 without having to separate each front wall.

Figure 14:
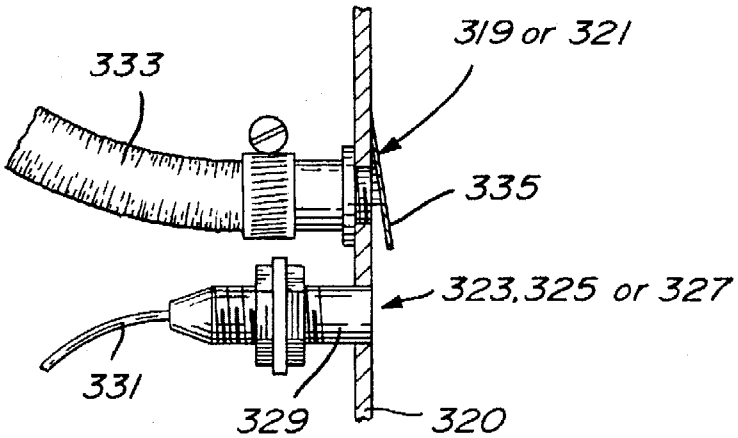
FIG. 14 is a fragmented sectional view of the rear wall of the housing.

Mounted in the door 317 are blowers 319 and 321 and sensors 323, 325 and 327. The blowers and sensors are mounted on PLEXIGLAS™ plates 320 which are mounted in openings of door 317. As seen in FIG. 14, the sensor comprises a photoelectric device 329 connected by a connector 331 to a control mechanism. The blowers 319 and 321 each comprise an air hose 333 and a deflector 335.

As seen in FIGS. 3 and 5, mounted in the extension 123 of the housing 121 is a plunger consisting of a piston 337 and a cylinder 341. Disposed at the free end of the piston is a ram head 339.

FIG. 16 illustrates an arrangement for controlling the operation of the plunger. As can be seen, sensors 323, 325 and 327 are connected to a control mechanism 341 for controlling the plunger. The output of the control mechanism is connected to a plunger drive mechanism 343.

As also seen in FIG. 16, the output of sensors 323, 325 and 327 are fed to feed control 345 for controlling drive 347 for driving conveyors 161 and 163. The output of control 345 is fed to conveyor drive 347 for driving conveyors 161 and 163.

Finally, the outputs of the sensors 323, 325 and 327 are fed to a control mechanism 349 for controlling drive 351 for driving the piston and cylinder arrangement 155/157.

In operation, the apparatus works as follows:

Before starting the operation, a once only adjustment is made. Specifically, the fork arms 115 and 117 are adjusted to a substantially horizontal attitude by levers 1005 and 1007 respectively as shown in FIGS. 7 and 8. The fork arms 115 and 117 are adjusted to a substantially horizontal position, and then they are locked into position by screws 1023 and 1025 respectively. This adjustment has to be made only once although it is possible that the position of fork arms 115 and 117 would have to be trimmed at later times.

An empty housing 121, in the open position, is brought to a position intermediate work stations 101 and 103. The housing 121 is in the open condition as illustrated in FIG. 4 (although in FIG. 4 the housing is shown at the second work station 103).

At the intermediate position, a pallet 104 is inserted within the open housing 121, and the housing is then closed and moved together with the pallet to the first work station 101. As the housing and pallet approach the work station 101, the fork arm 115 and 117 extend in spaces 172 and 174 (see FIG. 10) so as to underlie the top deckboard of the pallet 104.

Upon the starting up of the apparatus, hydraulic jacks 1009A and 1009B are activated so as to move the fork arms 115 and 117 into engagement with the top deckboard of the pallet 104 and thereby support same. Trough 143 is moved into a charging position within extension 123 by the piston and cylinder arrangement 155/157 as shown in FIG. 6. The loading end (not shown) of trough 141 is disposed adjacent the source of peat moss, and the peat moss is picked up by the conveyor 161 and conveyed to the discharge end of the trough 141. The peat moss then falls out of the trough 141 onto the conveyor 163 of trough 143. Conveyor 163 then brings the peat moss to the discharge end of trough 143, and the peat moss then drops off conveyor 163 into the compression chamber 128 through the top opening of housing 121 and onto the cardboard or plastic sheet 126 overlying the pallet 104. Because of the positioning of the discharge end of the trough 143 within the extension 123, the peat moss will be evenly distributed along the cross-section of the compression chamber 128.

Peat moss is charged into the compression chamber 128 until the level of the peat moss charge reaches the level of sensor 323.

The sensor 323 then detects that the level of the peat moss in the compression chamber 128 is at a first desired position for compression. It therefore sends a signal to control 349 for operating piston and cylinder 155/157 for retracting trough 143, and to control 341 for the plunger drive which, in turn, will activate the plunger drive mechanism 343.

At the same time, sensor 323 sends a signal to controller 345 for conveyors 161 and 163 which will send a signal to conveyor drive 347 to stop the conveyors 161 and 163.

The piston and cylinder arrangement 337/341 then operates to push the ram head 339 downwardly to compress the peat moss. The limit of the extension of the ram head 333 into the compression chamber is controlled by a first limit switch not shown in the drawings.

It is noted that a great deal of pressure is applied by the piston and cylinder arrangement 337/341 so that if the pallet 104 were unsupported, the pallet could not withstand the pressure. This is the reason for providing fork arms 115 and 117, supported by hydraulic jacks 1009A and 1009B, to underlie the top deckboard of the pallet 104.

After the compression stroke, the ram head 339 is raised to the position illustrated in FIG. 3. The return of ram head 339 to this position is sensed by a sensor, for example, switch 350 as shown in FIG. 3, whereupon trough 143 is moved into the charging position shown in FIG. 6, and conveyors 161 and 163 are set into motion once again to further charge the compression chamber 128 with additional peat moss.

The compression chamber 128 is then charged until the level of peat moss reaches the level of sensor 325. At this point, trough 143 is withdrawn, conveyors 161 and 163 are stopped, and the ram head is activated as above described. The extent to which the ram head extends into the compression chamber is monitored by a second limit switch, also not shown.

Compression chamber 128 is charged once again until the level of peat moss in the compression chamber reaches sensor 327. This will initiate a final compression stroke.

At the end of the third compression stroke, hydraulic jacks 1009A and 1009B are deactivated so that fork arms 115 and 117 are no longer pushed up against the under surface of the top deck of pallet 104. First conveyor arrangement 193 moves the housing 121, with its load of compressed peat moss therein, from the first work station 101 to the second work station 103.

It is pointed out that the non-adhesive layer 137 on the walls of the housing is provided to prevent adhesion of peat moss to the inner surface of the walls, for example, upon opening of the housing at the second work station 103 as will be described below. Blowers 319 and 321 are provided to blow away any peat moss which may have nevertheless adhered to the sensing surfaces of sensors 323, 325 or 327 whereby to cleanse the sensing surfaces. Blowers 319 and 321 operate on a continuous basis.

In spite of the non-adhesive surface 137, it is nevertheless possible that the ram head 339 will make frictional contact with the inner surface of the housing and therefore tend to lift the housing 121 upwardly when the ram head is being lifted upwardly. The hold-down arrangements 251 and 253 are provided to prevent the ram head 339 from lifting the housing 121 upwardly under these conditions. The hold-down arrangements 251 and 253 also prevent any upward movement of the housing 121 which may be caused by an upward expansion of the compressed peat moss after the ram head has been lifted.

When the housing 121, with its load of compressed peat moss therein, is moved to the second work station 103, the housing is opened by piston and cylinder arrangements 185 and 187 as shown in FIG. 4. The operation of the piston and cylinder arrangements 185 and 187 can either be initiated manually or automatically by providing sensors to sense that the housing 121 has arrived at work station 103.

Housing 121, in its open position as seen in FIG. 4, is then returned to the first work station 101, thereby exposing the body of compressed peat moss 102. The housing is returned to work station 101, and a pallet is inserted thereunder, as above described, in preparation for a further charging and compression cycle.

When housing 121 is moved away from work station 103, wrapper unit 275 is moved from its unoperative position, as shown in FIG. 3, to its operating position as shown in FIG. 5. Once again, this movement could be effected either manually (i.e., by pressing a press-to-operate button), or automatically, by a sensor which senses the retracting of the housing 121.

Wrapping unit 275 wraps a plastic film material around the outer surface of the peat moss body 102. For this purpose, roller 295 comprises stretcher rolls 2962 to pre-stretch the plastic film material, and applicator roll 2960 to unroll the plastic film from the feed roll 296 onto the surface of the peat moss body 102. Roller 295 is moved upwardly and downwardly by chain 297 so that a double layer of pre-stretched plastic film material is wrapped on the outer surface of the body of compressed peat moss 102.

The palletized peat moss 100 is then moved by conveyor arrangement 195 from work station 103 to a loading station (not shown) for loading the palletized peat moss on a vehicle for shipping to either a warehouse or to a customer.

Although a particular embodiment has been described, this was for the purpose of illustrating, but not limiting, the invention. Various modifications, which will come readily to the mind of one skilled in the art, are within the scope of the invention as defined in the appended claims.

We claim:

1. Palletized peat moss in bulk compressed form, comprising a pallet, a body of compressed peat moss in bulk form upstanding from said pallet and compressed directly thereon, said peat moss having a water-content in the range of about 25 to about 50 weight %, and a fluid impervious wrap material wrapping said body of compressed peat moss so as to retain the peat moss in bulk compressed form on said pallet and to maintain the water-content of said peat moss, said wrap material and said pallet defining an enclosure completely enclosing said body of peat moss with said enclosure having a bottom constituted by said pallet.

2. Palletized peat moss as claimed in claim 1, wherein said peat moss is in admixture with at least one mineral or organic aggregate.

* * * * *